United States Patent [19]

Krause et al.

[11] Patent Number: 4,621,416

[45] Date of Patent: Nov. 11, 1986

[54] AMORPHOUS METAL TRANSFORMER WITH LOW LOSS CORE

[75] Inventors: Robert F. Krause, Murrysville; Curtis J. Gosik, East Pittsburgh, both of Pa.

[73] Assignee: Westinghouse Electric Corp., Pittsburgh, Pa.

[21] Appl. No.: 383,399

[22] Filed: Jun. 1, 1982

[51] Int. Cl.[4] ..... H01F 7/06

[52] U.S. Cl. ..... 29/606; 148/108

[58] Field of Search ..... 29/605, 606; 148/108; 242/7.03

[56] References Cited

U.S. PATENT DOCUMENTS 4,081,298 3/1978 Mendelsohn et al. ..... 148/108

4,206,621 6/1980 Kawasaki et al. ..... 29/605

4,262,233 4/1981 Becker et al. ..... 148/108

4,312,683 1/1982 Sakakima et al. ..... 148/108

*Primary Examiner*—Howard N. Goldberg

*Assistant Examiner*—P. W. Echols

*Attorney, Agent, or Firm*—L. P. Johns

[57] ABSTRACT

A method of reducing core losses in a magnetic core characterized by the steps of winding a strip of a previously annealed amorphous magnetic alloy strip into a magnetic core; applying a primary winding onto the magnetic core to establish an AC exciting field in the core; applying a secondary winding onto the core; and applying a DC or a low frequency AC magnetic field to the core at an angle that is non-coincident to the AC exciting field to effect reduced high frequency core losses.

5 Claims, 14 Drawing Figures

CORE LOSS W/lb
.10
.8
.6
.4
-6
-4
-2
0
2
4
6
BIAS CURRENT AMPS ( 1 AMP ≅ 130 Oe)

AMORPHOUS METAL TRANSFORMER WITH LOW LOSS CORE

CROSS-REFERENCE TO RELATED APPLICATION

This application is related to and is an improvement over the application, Ser. No. 239,087, filed Feb. 27, 1981, now abandoned, in the name of Robert F. Krause, which application is assigned to the same assignee as the present application.

BACKGROUND OF THE INVENTION

1. Field of the Invention:

This invention relates to a method for making an amorphous metal transformer with low loss core.

2. Description of the Prior Art:

In recent years a series of amorphous metal alloys have been developed which exhibit excellent soft magnetic characteristics. Amorphous metal alloys, or metallic glasses, are produced by liquid quenching in which a molten alloy is rapidly cooled through a temperature range at which crystallization normally occurs. The non-crystalline structure is obtained by quench casting at cooling rates of nearly $10^{6}$° C. per second. The alloys involved consist usually of iron, nickel, and/or cobalt with predetermined amounts of silicon, boron, carbon, phosphorus, and show promise for use as transformer core material.

SUMMARY OF THE INVENTION

It has been found in accordance with this invention that a transformer may be provided which comprises a magnetic core of an annealed amorphous alloy cast from a base metal selected from the group consisting of iron, nickel, and cobalt; a primary winding on the core; and coil means on the core for directing a magnetic field at an angle that is non-coincident with an AC exciting field to effect reduced high frequency core losses; which acts as an intermittent means for stimulating the core with the non-coincident magnetic field.

The invention also comprises a method for reducing core losses in a magnetic core comprising the steps of winding a strip of amorphous magnetic alloy into a magnetic core, said alloy comprising a base metal selected from the group consisting of iron, nickel, and/or cobalt; applying primary winding onto the magnetic core to establish an AC exciting field in the core; applying a secondary winding on the core; applying a magnetic field to the core at an angle that is non-coincident to the AC exciting field to effect reduced high frequency core losses; and removing and reapplying the non-coincident magnetic field to the core as required.

The advantage of the disclosure of this invention is that significantly reduced core losses in a core are provided when the core is comprised of an amorphous metal alloy.

DESCRIPTION OF THE PREFERRED EMBODIMENTS

Figure 2:
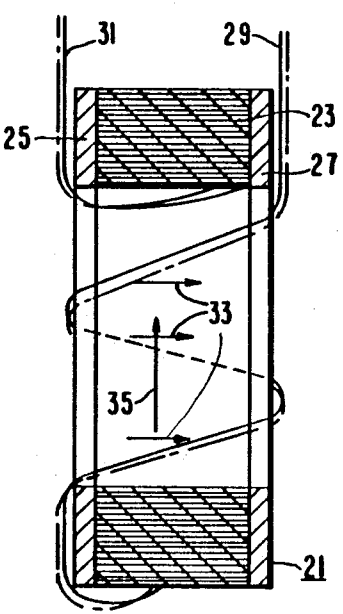
FIG. 2 is a sectional view taken on the line II—II of FIG. 1.
Figure 1:
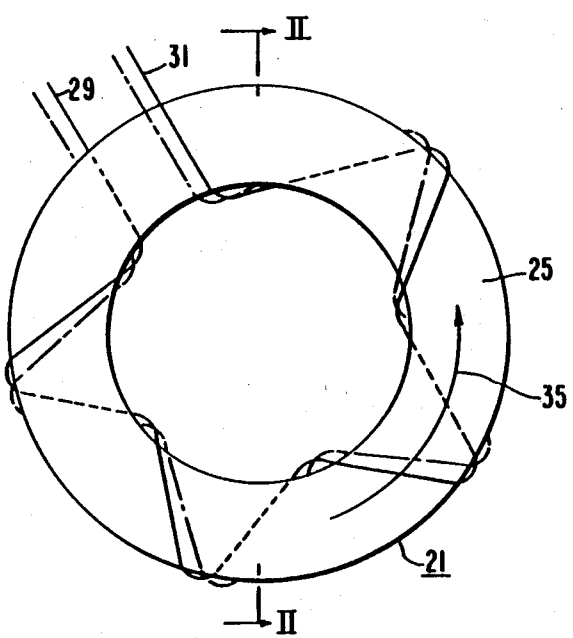
FIG. 1 is an elevational view of an assembly of a core, permanent magnets and primary and secondary windings in accordance with this invention.

In FIGS. 1 and 2 a transformer is generally indicated at 21 and it comprises a core 23, a pair of permanent magnets 25, 27, a primary winding 29, and a secondary winding 31. The core 23 comprises a toroid which is prepared by winding helically a continuous strip of amorphous metallic alloy into the substantially cylindrical form (FIG. 2). The continuous strip of amorphous alloy has a thickness of from about 0.001 to about 0.002 inch. The alloy is comprised of a base metal selected from the group consisting of iron, nickel, cobalt, and mixtures thereof. An example of the alloy is $Fe_{81}B_{13.5}Si_{3.5}C_2$. Generally, the material consists largely of iron with the predetermined amounts of silicon, boron, carbon and other elements. The alloy is amorphous or noncrystalline by virtue of the fact that it is quenched at a rate of nearly $10^{6}$° C. per second during casting of the alloy into the continuous strip form. Typical amorphous compositions are $Fe_{29}Ni_{49}P_{14}B_4Si_2$;
$Fe_3Co_{10}Si_{15}B_{10}$;
$Fe_{40}Ni_{40}P_{14}B_6$;
$Fe_{40}Ni_{40}P_{14}B_6$;
$Fe_{40}Ni_{40}B_{20}$;
$Fe_{50}Ni_{30}P_{14}B_6$;
$Fe_{80}P_{14}B_6$
$Fe_{78}B_{12}Si_{10}$
$Fe_{80}P_{16}C_3B_1$
$Fe_{80}B_{20}$; and
$Fe_{81}B_{13.5}S_{3.5}C_2$ After the strip is quenched it is coated with a suitable insulating material, such as magnesium methylate, and is then annealed in a temperature range of from about 320° to 440° C. and preferably at 365° C. for two hours in a non-oxidizing atmosphere, such as 15% $H_2$—85% $N_2$. The core 23 is wound with a plurality of turns.

The magnets 25, 27 are permanent magnets and are disposed on opposite ends of the wound core 23 so as to serve as a source of a magnetic field extending through the core 23 at an angle indicated by arrow 33 that is non-coincident to the exciting field of the core. The magnets 25, 27 are flat discs comprised of a conventional permanent magnetic material such as soft iron.

The primary winding 29 extends around both the assembly of the core 23 and the magnets 25, 27 substantially as shown in FIGS. 1 and 2 for the purpose of inducing an AC exciting field in the core in the direction of the arrow 35.

The secondary winding 31 is likewise wrapped around the assembly of the core 23 and magnets 25, 27 (FIGS. 1, 2).

Figure 3:
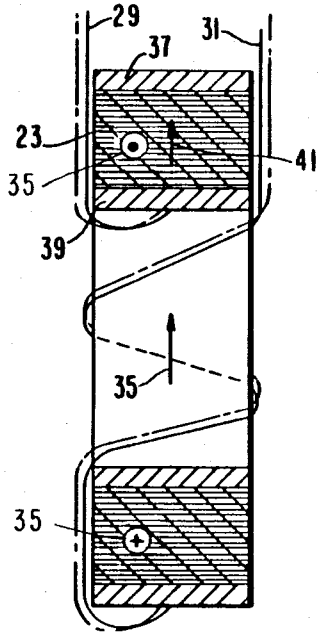
FIG. 3 is a sectional view of another embodiment of the invention.

Another embodiment of the invention is shown in FIG. 3 in which the core 23 is assembled with a pair of cylindrical permanent magnets 37, 39 concentrically disposed on inner and outer side surfaces of the core. The permanent magnets 37, 39 provide a field in the direction indicated by the arrow 41 which again is disposed at an angle which is non-coincident with the AC exciting field 35 of the core 23. This embodiment also includes primary and secondary windings 29, 31 as in the prior embodiment.

Figure 5:
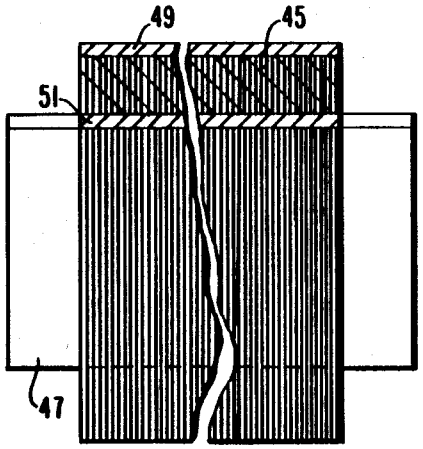
FIG. 5 is a sectional view taken on the line V—V of FIG. 4.
Figure 4:
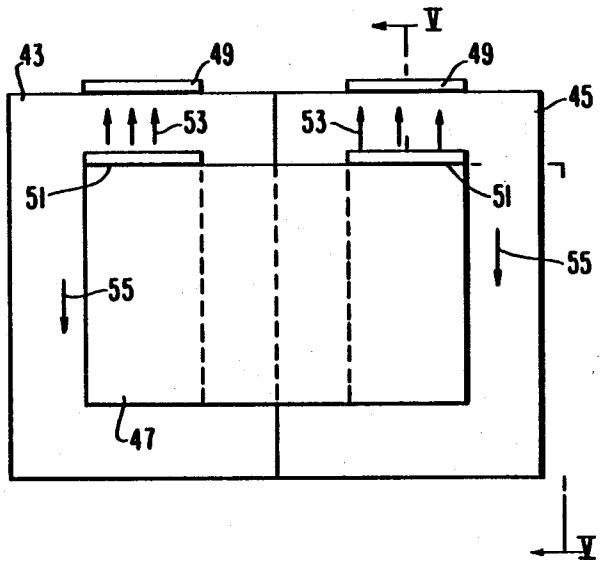
FIG. 4 is an elevational view of another embodiment of the invention.

Another embodiment of the invention is shown in FIGS. 4 and 5 which comprises a pair of cores 43, 45 disposed in side-by-side positions with a coil 47 extending therethrough in a conventional manner. A pair of permanent magnets 49, 51 are disposed concentrically on opposite sides of the core 45 to provide a magnetic field indicated by arrows 53 which field is disposed at an angle to the AC exciting field 55 of the cores 43, 45.

Figure 6:
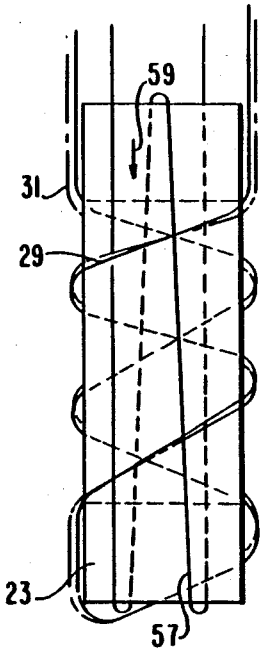
FIG. 6 is an elevational view of another embodiment of the invention.

The embodiments shown in FIGS. 1–5 include permanent magnets for providing DC magnetic fields through the cores 23 at an angle non-coincident to the exciting fields therethrough. In each embodiment the non-coincidence is at an angle of 90° to the exciting field, but angles other than 90° are equally operative. However, the invention is not limited to the use of DC magnetic fields. As shown in FIG. 6, the core 23 having windings 29, 31 is devoid of permanent magnets such as 25, 27 and 49, 51. A bias winding 57 is disposed around the periphery of the core 23 (FIG. 6) to thereby provide a DC or low frequency AC magnetic field (arrow 59) which is non-coincident to the exciting field induced by the primary windings 29, as disclosed in the foregoing embodiments.

Accordingly, an intermittent DC or low frequency AC magnetic field is applied to a magnetic core in such a way that the intermittent field is non-coincident with the applied AC exciting field of the core. In the embodiments of FIGS. 1–5, a DC field perpendicular to the applied DC exciting field is shown. The following example illustrates the reduction in core loss observed in the application of a DC field applied at an angle non-coincident to the AC exciting field.

EXAMPLE I

Figure 10:
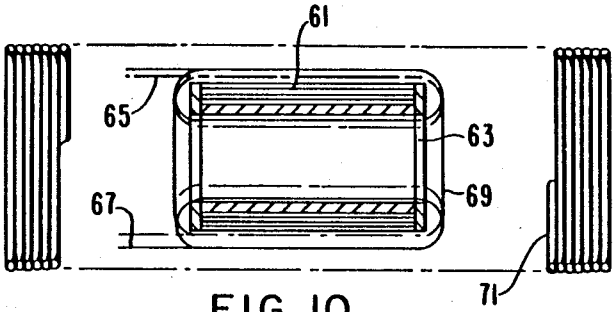
FIG. 10 is a cross section of bias field test apparatus showing a core-coil apparatus within a solenoid.

A strip of 1 inch wide amorphous alloy ribbon was wound up to form a core 61 on a core form 63 (FIG. 10) and magnetically annealed at 365° C. for two hours in an atmosphere of 15% $H_2$—85% $N_2$ gas to provide a magnetically annealed amorphous core. A primary winding 65 of 200 turns and a second winding 67 of 200 turns was wound on the core 61. The resulting transformer 69 was inserted into a solenoid 71 with the axis of the core 61 parallel with the axis of the solenoid. A DC magnetic field created by a current flow in the solenoid 71 was in the plane of the strip forming the coil 61 but at a right angle to the field created by the current flow in the primary winding 65 around the test core. The test core 61 was AC excited to a set induction and the core loss (in relative units) was observed with a wattmeter. The solenoid 71 was then energized with a DC current. In most cases as the solenoid was energized, the induction remained fixed and the wattmeter readings decreased. The current in the solenoid was slowly increased until a minimum wattmeter reading was observed or the voltage limit of the solenoid power supply was reached prior to obtaining the minimim watt loss. Test data are shown in Table I.

TABLE I

| Test Frequency (Hz) | Secondary Flux Volts | Total Watt No DC Field | Wattmeter Reading With DC Field | Percent Improvement | Comments |
|---|---|---|---|---|---|
| 10,000 | 5 | .0065 | .0043 | 34 | NMA* |
| | 10 | .0230 | .0148 | 36 | NMA* |
| | 20 | .0807 | .0560 | 31 | NMA* |
| | 30 | .164 | .113 | 31 | NMA* |
| 6,000 | 5 | .0074 | .0057 | 23 | NMA* |
| | 10 | .0255 | .0196 | 23 | NMA* |
| | 20 | .0915 | .0703 | 23 | NMA* |
| 600 | 1 | .0008 | .0011 | — | Impairment in Losses |
| 60 | — | — | — | — | Impairment in Losses |

*NMA - "No Minimum Achieved" - The wattmeter was still decreasing when the solenoid DC power supply reached full capacity.

In most cases the application of a DC field perpendicular to the applied AC field significantly reduced the core loss. Moreover, the minimum core loss was not achieved because of power supply limitations and thus even further loss reductions are anticipated. Failure to observe a loss improvement at 600 Hz and 60 Hz does not necessarily indicate that loss reduction cannot be achieved at these frequencies, but only that they do not occur under the specific test conditions used in this experiment. This experiment shows that a DC magnetic field applied perpendicular to the AC exciting field and in the plane of the strip results in a significant reduction in core loss. It is anticipated that if the DC field is replaced by an AC field of a lower frequency than the major AC exciting field, the core loss effect is likewise obtained.

Figure 8:
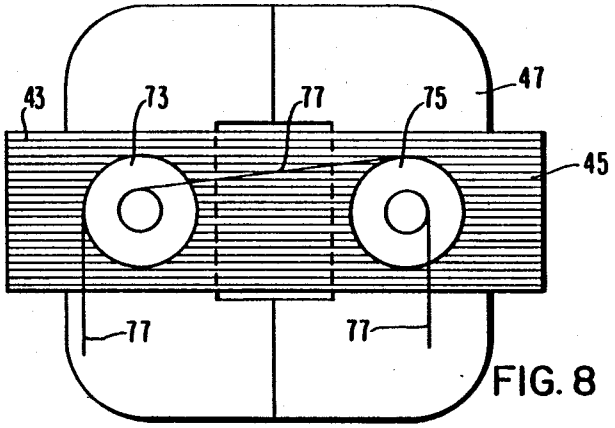
FIG. 8 is a plan view of the embodiment shown in FIG. 7.
Figure 7:
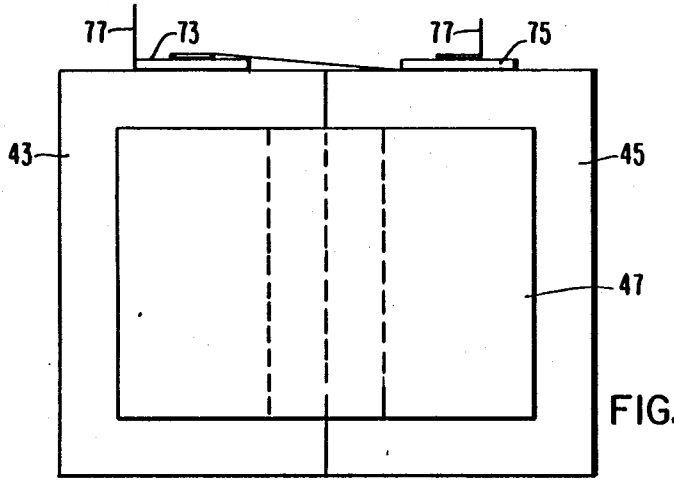
FIG. 7 is an elevational view of another embodiment of the invention.

Another embodiment of the invention is shown in FIGS. 7 and 8 in which the assembly of the cores 43, 45 and coil 47 are provided with biased coils 73, 75. As is shown a coil lead 77 is helically wound to provide the coil 75 which lead extends from an outer periphery to the position of the coil 73 where a similar coil structure is wound and from where the lead 77 extends outwardly (FIG. 8). In this embodiment an intermittent bias field induced by the coils 73, 75 extends over only a portion of the cores 43, 45. In such an embdiment where an active coil is used to create the bias field, the $I^2R$ loss due to the current flow in this coil will reduce total loss reduction in the composite structure.

Figure 9:
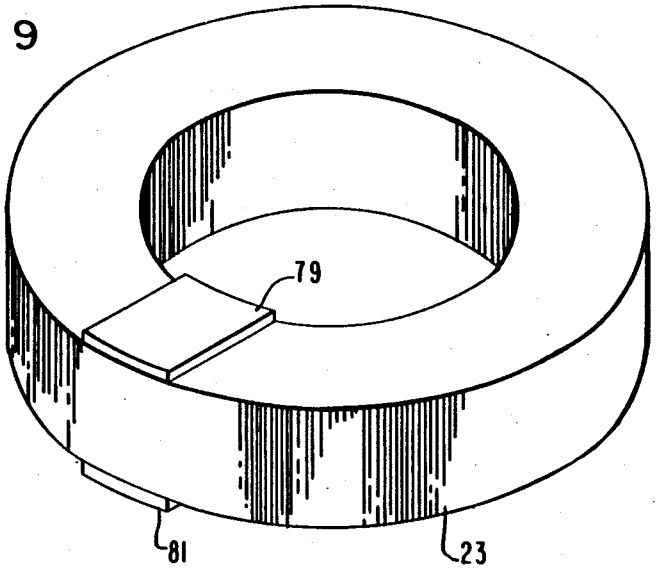
FIG. 9 is an isometric view of another embodiment of the invention showing a wound core and permanent magnets.

As indicated the permanent magnets 25, 27 (FIG. 2) on the core 23 create the bias field. The magnets may create the bias field over the entire core (FIG. 2), or only over a small segment of the core as shown by magnet segments 79, 81 on the core 23 (FIG. 9).

Associated with the foregoing is the application and subsequent removal of a DC or a low frequency AC magnetic field applied non-coincident with the AC field windings of an amorphous metal core. A more limiting case is the application and subsequent removal of a DC field applied perpendicular to the applied AC exciting field (FIGS. 1 and 29). After removal of the bias the losses are lower in the core than the losses prior to the application of the bias field for an indefinite period of time.

The following examples illustrate the loss improvement in this limiting case.

EXAMPLE II

A strip of one inch wide amorphous strip (Alloy 2605 SC) was coated with magnesium methylate, wound on a core form, and magnetically annealed at 380° C. for 2 hours in a 15% $H_2$—85% $N_2$ atmosphere. The core was wound with a 200-turn primary and 200-turn secondary. The core-coil assembly was placed inside a solenoid such that the axis of the core was parallel to the axis of the solenoid, FIG. 10. Thus, any DC magnetic field created by a current flow in the solenoid would be in the plane of the strip but at right angles to the AC field created by a current flow in the primary windings around the test core.

The 60 Hz demagnetized test core was AC excited to a set induction and frequency and the magnetic properties recorded. The DC solenoid current was increased to six amps then returned to zero. The magnetic properties were remeasured at this zero current level. This test was performed over a frequency range from 1 kHz to 10 kHz and at inductions from 0.5 to 14 kG. In some cases, most noticeably at high inductions, severe wave form distortion limited the peak bias current to less than 6 amps. In these cases the bias current was taken as high as possible and returned to zero. The results of these tests appear in Table 2. In all cases, the losses were lower after the application and subsequent removal of the DC bias field. It should be noted that the greatest improvement occurred at lower inductions and for all practical purposes disappeared at high inductions.

EXAMPLE III

Figure 11:
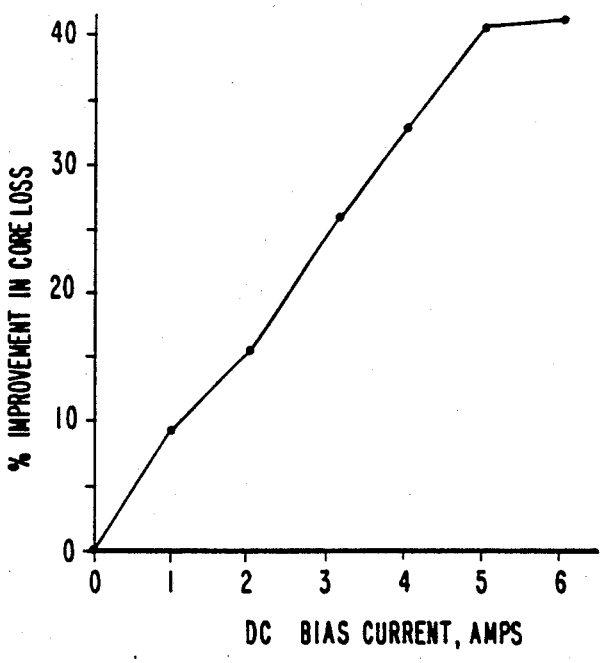
FIG. 11 is a graph showing the effect of the application and subsequent removal of a biased field on core loss (1 kG, 6 kHz)

The same experimental set-up was used to determine the effect of prior bias field strength on the zero bias field core loss conditions. The 60 Hz AC demagnetized core was AC excited to 1 kG, 6 kHz. The losses were measured. The DC solenoid current was increased to one amp, decreased to zero, and the properties remeasured. The core was then 60 Hz demagnetized and the test repeated with a higher DC bias current. The bias currents ranged from 1 to 6 amps in one amp increments. The results, FIG. 11, show a continual reduction in core loss with increased prior bias currents. Although the improvement increased with increasing current, this loss reduction approaches a saturation level near the 5 to 6 amp range.

EXAMPLE IV

Figure 12:
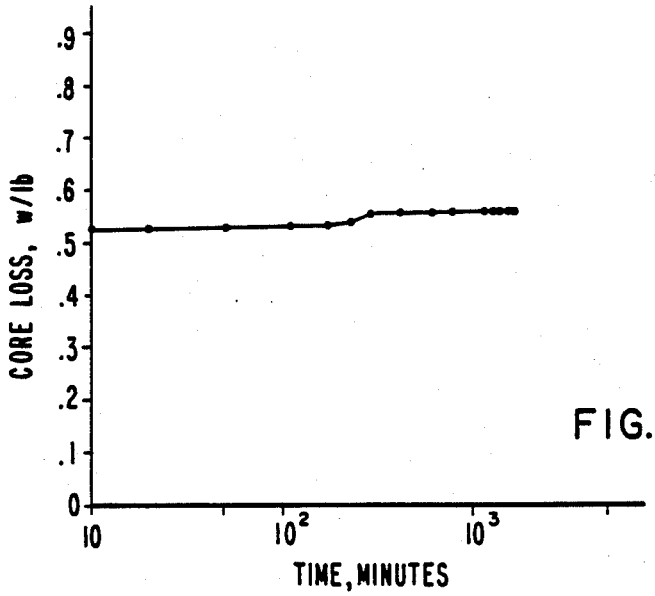
FIG. 12 is a graph showing the effect of time on core loss measured after the application and removal of a 760 oersteds bias field (1 kG, 16 kHz)

Once again the same experimental set-up was used. The sample was maintained at 1 kG, 6 kHz. The bias field was increased from zero to six amps and back to zero. The losses were measured as a function of time. The results, FIG. 12, show that the losses changed very little over the length of the test (27 hours).

EXAMPLE V

Figure 13:
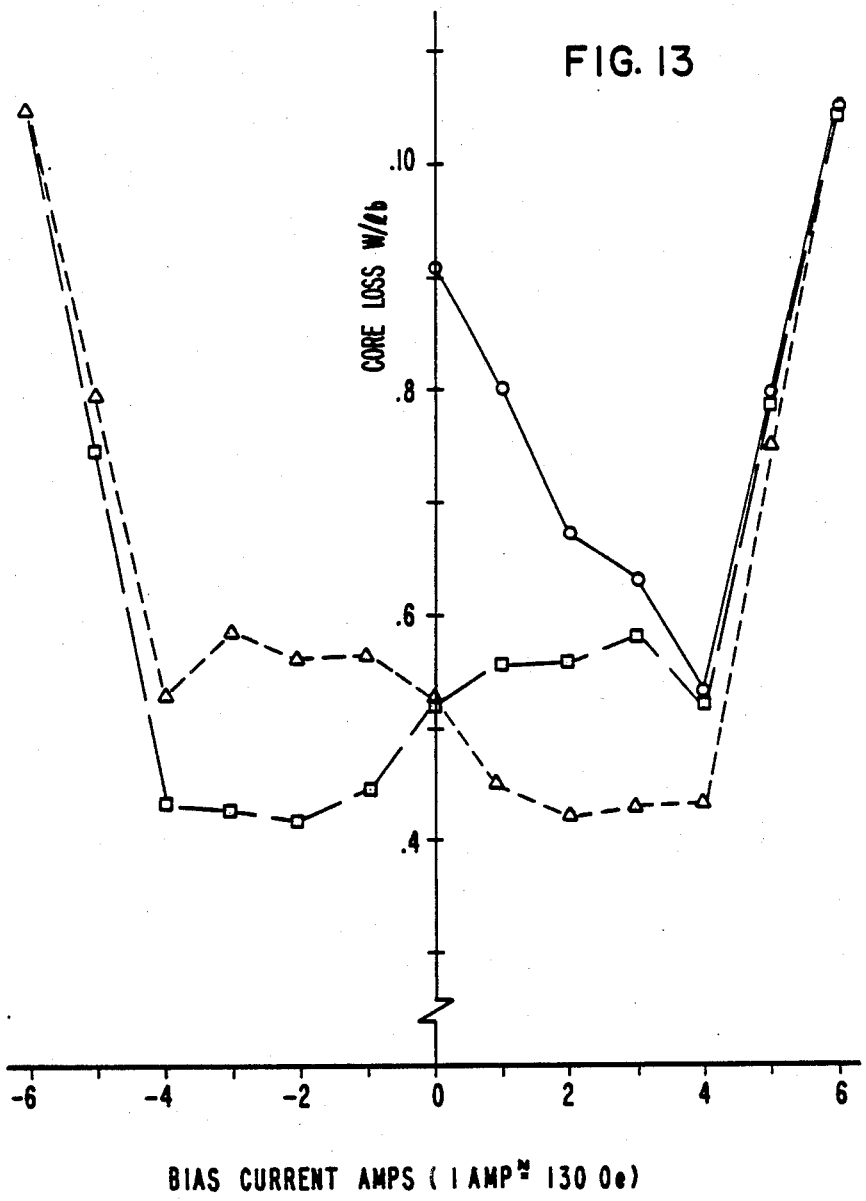
FIG. 13 is a graph showing the effect of the application and subsequent removal of a biased field on core loss (lamp ~130 oe)
Figure 14:
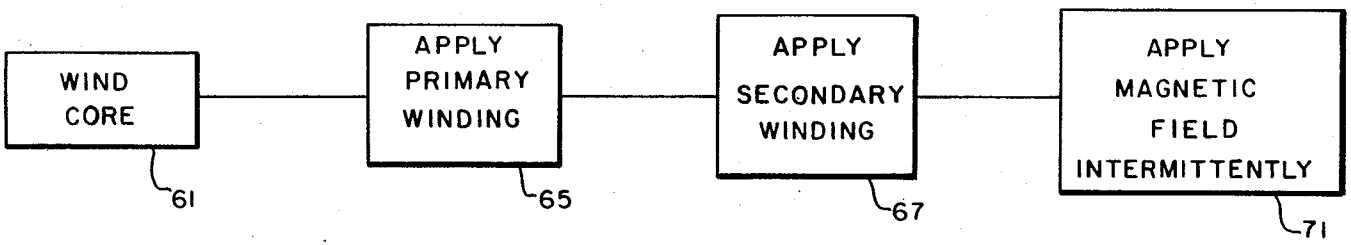
FIG. 14 is a block diagram showing the steps of the sequence involved in the disclosed method.

The same experimental set-up as above was used. A sample was maintained at 1 kG, 6 kHZ. The bias field was increased from 0 to +6 amperes, back to zero, to a −6 amperes, to zero, and finally to +6 amperes. The losses were measured as a function of bias field strength. The results are presented in FIG. 13.

TABLE 2

EFFECT OF APPLICATION AND SUBSEQUENT REMOVAL OF A 760 Oe++ BIAS FIELD ON CORE LOSS

| INDUCTION (kG) | Pc at 1 kHz (W/lb) | | Pc 2 kHz (W/lb) | | Pc at 4 kHz (W/lb) | | Pc at 6 kHz (W/lb) | | Pc at 8 kHz (W/lb) | | Pc at 10 kHz (W/lb) | |
|---|---|---|---|---|---|---|---|---|---|---|---|---|
| | Before** | After | Before** | After | Before** | After | Before** | After | Before** | After | Before** | After |
| 0.5 | — | — | 0.063 | 0.028 | — | — | 0.243 | 0.120 | 0.326 | 0.188− | 0.381 | 0.272 |
| 1.0 | 0.072 | 0.039 | 0.184 | 0.107 | 0.534 | 0.313 | 0.918 | 0.512 | 1.37 | 0.802 | 1.78 | 1.08 |
| 2.0 | 0.248 | 0.179 | 0.596 | 0.460 | 1.60 | 1.19 | 2.85 | 2.08 | 4.29 | 3.27 | 5.86 | 4.75 |
| 4.0 | 0.688 | 0.620 | 1.70 | 1.55 | 4.31 | 3.97 | 4.97 | 7.42 | 11.6 | 11.1 | 15.6 | 15.4 |
| 6.0 | 1.18 | 1.10 | 2.94 | 2.76 | 7.59 | 7.40 | 13.2 | 13.0 | 20.6 | 20.2+ | 28.0 | 27.8+ |
| 8.0 | — | — | 4.38 | 4.32 | 11.6 | 11.2+ | 20.6 | 20.4+ | 31.6 | 31.3+ | 42.5 | 41.7+ |
| 10.0 | — | — | 6.42 | 6.62+ | 16.4 | 16.2# | 29.2 | 29.1# | 44.4 | 43.9* | — | — |
| 12.0 | 3.57 | 3.57* | 8.87 | 8.81# | 22.1 | 21.9# | 39.2 | 38.6* | — | — | — | — |
| 14.0 | — | — | 12.6 | 12.6* | 31.1 | 30.9* | — | — | — | — | — | — |

**Prior condition-60 Hz demagnetized
*Application and removal of a 380 Oe field
#Application and removal of a 500 Oe field
+Application and removal of a 630 Oe field
++Unless otherwise noted In accordance with this invention it has been found that the application and subsequent removal of a DC, or a low frequency AC magnetic field, results in low core losses. However, since long term stability of the loss reduction is limited, intermittent reapplication of the non-coincident, DC or low frequency AC magnetic field is necessary. This may be accomplished by a number of means, such as by discharging a capacitor through a single turn bias field winding as required.

What is claimed is:

1. A method of reducing core losses in a magnetic core comprising the steps of (a) winding a strip of an amorphous magnetic alloy into a magnetic core;

(b) applying a primary winding onto the magnetic core to establish an AC exciting field in the core;

(c) applying a secondary winding onto the core; and (d) intermittently applying one of a DC and a low frequency AC magnetic field to the core at an angle that is non-coincident to the AC exciting field to effect reduced high frequency core losses.

2. The method of claim 1 in which at step (a) the amorphous magnetic alloy is anneal before step (b).

3. The method of claim 2 in which the amorphous magnetic strip is an alloy comprising a base metal selected from the group consisting of iron, nickel, cobalt, and mixtures thereof.

4. The method of claim 2 in which the DC field has a range of from about 0 to 5000 oersteds.

5. The method of claim 2 in which the low frequency AC field has a range of from about 0 to 500 oersteds.

* * * * *